US007968813B2

(12) United States Patent
McCoy

(10) Patent No.: US 7,968,813 B2
(45) Date of Patent: Jun. 28, 2011

(54) SWITCHING DEVICE CONTACT ARM AND ARMATURE PLATE

(75) Inventor: Brian Timothy McCoy, Lawrenceville, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 515 days.

(21) Appl. No.: 11/983,298

(22) Filed: Nov. 8, 2007

(65) Prior Publication Data

US 2008/0135390 A1 Jun. 12, 2008

Related U.S. Application Data

(60) Provisional application No. 60/865,199, filed on Nov. 10, 2006.

(51) Int. Cl.
*H01H 9/00* (2006.01)

(52) U.S. Cl. ..... 200/308; 200/244

(58) Field of Classification Search ..... 200/308, 200/244

See application file for complete search history.

(56) References Cited

U.S. PATENT DOCUMENTS

| | | | | |
|---|---|---|---|---|
| 4,808,952 | A * | 2/1989 | Berner et al. | 335/41 |
| 5,105,059 | A | 4/1992 | Sorenson et al. | |
| 6,479,774 | B1 * | 11/2002 | Castonguay et al. | 200/401 |

FOREIGN PATENT DOCUMENTS

| | | | |
|---|---|---|---|
| EP | 1 059 653 | A2 | 12/2000 |
| EP | 1 059 653 | A3 | 1/2002 |
| GB | 1 278 058 | A | 6/1972 |
| GB | 2 274 744 | A | 8/1994 |

* cited by examiner

*Primary Examiner* — Edwin A. Leon
*Assistant Examiner* — Vanessa Girardi
(74) *Attorney, Agent, or Firm* — Filip A. Kowalewski

(57) ABSTRACT

A control module for selectively switching electrical power from an electrical power source to a load circuit comprises a housing. An electromechanical actuator in the housing has a movable plunger. A fixed contact is fixedly mounted in the housing and is electrically connected to a first electrical terminal. A conductive contact arm in the housing comprises an elongate bar having a turn defining opposite first and second legs. The contact arm is pivotally mounted in the housing proximate the turn and is operatively connected to the plunger to be selectively positioned thereby. The contact arm further comprises a conductor tab proximate the turn. The first leg includes a movable contact for selectively electrically contacting the fixed contact. The second leg includes a user interface operator.

18 Claims, 7 Drawing Sheets

SWITCHING DEVICE CONTACT ARM AND ARMATURE PLATE

CROSS REFERENCE TO RELATED APPLICATIONS

This application claims priority of provisional application No. 60/865,199 filed Nov. 10, 2006, the contents of which is incorporated by reference herein.

FIELD OF THE INVENTION

This invention relates generally to residential and commercial electrical power distribution panels and components, and more particularly, to a contact arm including an armature plate for a switching device for controlling loads, particularly lighting loads and air conditioning loads, in an electrical power distribution system.

BACKGROUND OF THE INVENTION

Circuit breaker panels are used to protect electrical circuitry from damage due to an overcurrent condition, such as an overload, a relatively high level short circuit, or a ground fault condition. To perform that function, circuit breaker panels include circuit breakers that typically contain a switch unit and a trip unit. The switch unit is coupled to the electrical circuitry (i.e., lines and loads) such that it can open or close the electrical path of the electrical circuitry. The switch unit includes a pair of separable contacts per phase, a pivoting contact arm per phase, an operating mechanism, and an operating handle.

In the overcurrent condition, all the pairs of separable contacts are disengaged or tripped, opening the electrical circuitry. When the overcurrent condition is no longer present, the circuit breaker can be reset such that all the pairs of separable contacts are engaged, closing the electrical circuitry.

In addition to manual overcurrent protection via the operating handle, automatic overcurrent protection is also provided via the trip unit. With an electro-mechanical tripping type circuit breaker, the trip unit senses the electrical circuitry for the overcurrent condition and automatically trips the circuit breaker. When the overcurrent condition is sensed, a tripping mechanism actuates the operating mechanism, thereby disengaging the first contact from the second contact for each phase. Typically, the operating handle is coupled to the operating mechanism such that when the tripping mechanism actuates the operating mechanism to separate the contacts, the operating handle also moves to a tripped position.

Switchgear and switchboard are general terms used to refer to electrical equipment including metal enclosures that house switching and interrupting devices such as fuses, circuit breakers and relays, along with associated control, instrumentation and metering devices. The enclosures also typically include devices such as bus bars, inner connections and supporting structures (referred to generally herein as "panels") used for the distribution of electrical power. Such electrical equipment can be maintained in a building such as a factory or commercial establishment, or it can be maintained outside of such facilities and exposed to environmental weather conditions. Typically, hinge doors or covers are provided on the front of the switchgear or switchboard sections for access to the devices contained therein.

In addition to electrical distribution and the protection of circuitry from overcurrent conditions, components have been added to panels for the control of electrical power to loads connected to circuit breakers. For example, components have been used to control electrical power for lighting.

One system used for controlling electrical power to loads utilizes a remote-operated circuit breaker system. In such a system, the switch unit of the circuit breaker operates not only in response to an overcurrent condition, but also in response to a signal received from a control unit separate from the circuit breaker. The circuit breaker is specially constructed for use as a remote-operated circuit breaker, and could contain a motor or other actuating means for actuating the switch unit.

In an exemplary remote-operated circuit breaker system, a control unit is installed on the panel and is hard-wired to the remote-operated circuit breaker through a control bus. When the switch unit of the circuit breaker is to be closed or opened, an operating current is applied to or removed from the circuit breaker actuating means directly by the control panel. Additionally, separate conductors are provided in the bus for feedback information such as contact confirmation, etc., for each circuit breaker position in the panel. The control unit contains electronics for separately applying and removing the operating current to the circuit breakers installed in particular circuit breaker positions in the panel. The panel control unit also has electronics for checking the state of the circuit breaker, diagnostics, etc. One advantage of that system is that the individual circuit breakers can be addressed according to their positions in the panel.

As an alternative, a remote operated switching device can be provided as a discrete component for connection to a circuit breaker. Advantageously, a remote operated switching device performs numerous functions besides the basic switching operation. For example, it may be desirable to provide an indication as to the status of the switching device. Also, it may be necessary to provide a manual override for operating the switching device for trouble shooting or the like. The addition of such features can require numerous parts associated with operation of a movable contact. Moreover, related components such as bias springs, armature plates and the like, are required, as well as means for providing electrical terminations. All of this must advantageously be accomplished in a relatively small housing. At the same time, the contact structure must be capable of handling a current range of 15 to 50 amperes.

Contact arms are used in a variety of applications as moving parts to open or close a circuit and are commonly applied for use within or in conjunction with circuit breakers and/or lighting control devices in such an application. Known devices use the primary circuit breaker contact arm as a lighting control contact arm, while others may use a secondary contact arm with the same moldings of the lighting control circuit breaker. Such a contact arm is typically adapted to carry current, but not provide other functionality.

The present invention is directed to a contact arm and armature plate in a switching device.

SUMMARY OF THE INVENTION

In accordance with the invention, there is provided a contact arm and/or an armature plate in a switching device in an electrical power distribution system.

In accordance with one aspect of the invention, there is provided a switching device for selectively switching electrical power from an electrical power source to a load circuit. The switching device comprises a housing. An actuator is mounted for controlled movement in the housing. A fixed contact is fixedly mounted in the housing and is electrically connected to a first electrical terminal. A conductive contact arm is mounted in the housing. The contact arm is operatively connected to the actuator to be selectively positioned thereby and electrically connected to a second electrical terminal. The contact arm comprises an elongate bar having a turn defining opposite first and second legs. The first leg carries a movable contact for selectively electrically contacting the fixed contact. The second leg carries a user interface operator.

It is a feature of the invention that the user interface operator comprises a tab extending from a distal end of the second leg and further comprising a status indicator movably mounted in the housing and driven by the tab to indicate status of the switching device.

It is another feature of the invention that the user interface operator comprises a tab extending from a distal end of the second leg and further comprising an override knob movably mounted in the housing and driving the tab to override the actuator.

It is another feature of the invention that the second leg comprises a spring mount for receiving a spring for biasing the contact arm in a select position.

It is still another feature of the invention that the movable contact is mounted to a distal end of the first leg and the second leg comprises an opening proximate the turn for receiving a pivot rod for pivotally mounting the contact arm in the housing and a connector tab proximate the turn. A conductor electrically connects the connector tab to the second terminal.

It is yet another feature of the invention that the second leg comprises a spring mount at a distal end for receiving a spring for biasing the contact arm in a select position.

It is still an additional feature of the invention to provide an armature plate mounted on the first leg. The armature plate may be keyed to mount to the first leg in a pre-select orientation. More particularly, the armature plate may self align on the first leg.

There is disclosed in accordance with another aspect of the invention a control module for selectively switching electrical power from an electrical power source to a load circuit comprising a housing. An electromechanical actuator in the housing has a movable plunger. A fixed contact is fixedly mounted in the housing and is electrically connected to a first electrical terminal. A conductive contact arm in the housing comprises an elongate bar having a turn defining opposite first and second legs. The contact arm is pivotally mounted in the housing proximate the turn and is operatively connected to the plunger to be selectively positioned thereby. The contact arm further comprises a conductor tab proximate the turn. The first leg includes a movable contact for selectively electrically contacting the fixed contact. The second leg includes a user interface operator.

Further features and advantages of the invention will be readily apparent from the specification and the drawings.

DETAILED DESCRIPTION OF THE INVENTION

An electrical distribution system, such as an integrated lighting control system, in accordance with the invention permits a user to control power circuits typically used for lighting, as well as circuits for resistive heating or air conditioning, using multipole remote operated relays. The electrical distribution system may be as is generally described in U.S. application Ser. No. 11/519,727, filed Sep. 12, 2006, the specification of which is incorporated by reference herein, or as is more specifically described in U.S. application Ser. No. 11/635,299, filed Dec. 7, 2006, the specification of which is incorporated by reference herein.

Figure 1:
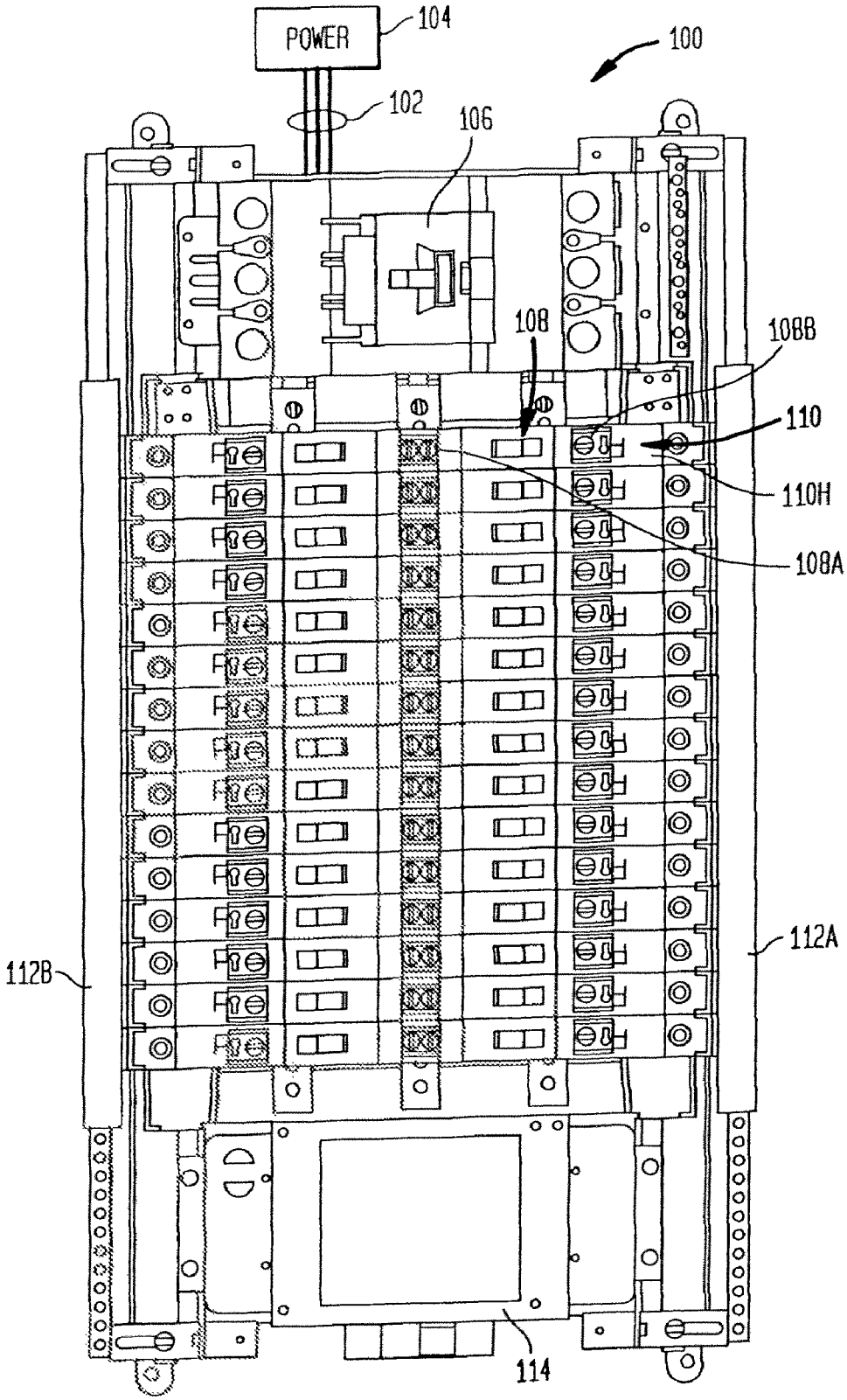
FIG. 1 is an elevation view of a power distribution panel according to the invention.

Referring to FIG. 1, a lighting control system in accordance with the invention comprises a lighting control panel 100. The panel 100 may comprise a Siemens type P1 panelboard, although the invention is not limited to such a configuration. Line power enters the panel 100 through power source cables 102 connected to a source of power 104. Line power may, for example, be a three phase 480Y277, 240 or 120 VAC power source, as is conventional. The cables 102 are electrically connected to an input side of a main breaker 106. The main breaker 106 distributes line power to individual circuit breakers 108 in a conventional manner. How the power is distributed depends on design of the individual circuit breakers 108, as will be apparent to those skilled in the art. The power is distributed to the line side of individual circuit breakers 108. The panel 100 may be configured to accept forty two or more individual circuit breakers 108, although only thirty are shown in the embodiment of FIG. 1. Each circuit breaker may be of conventional construction and may be, for example, a Siemens BQD circuit breaker. Each circuit breaker 108 includes a line terminal 108A receiving power from the main breaker 106 and a load terminal 108B conventionally used for connecting to a load circuit.

For simplicity of description, when a device such as a circuit breaker 108 is described generally herein the device is referenced without any hyphenated suffix. Conversely, if a specific one of the devices is described it is referenced with a hyphenated suffix, such as 108-1.

In accordance with the invention, each load circuit to be controlled also has a remote operated device or control module 110, in the form of a relay, a meter or a dimmer. The term remote operated device as used herein includes any other devices that controls, monitors or may otherwise be used in a load circuit, in accordance with the invention. While in a preferred embodiment, the remote operated device 110 is a separate component from the circuit breaker 108, the term "remote operated device" as used herein encompasses devices integral with the circuit breaker. The remote operated devices 110 are also connected to data rails 112A and 112B. A panel controller 114 controls the remote operated devices 110 through connections provided via the data rails 112A and 112B, as discussed below.

The remote operated device 110, in the form of a relay embodiment, includes a housing 110H encasing an auxiliary set of contacts that can be remotely operated to open and close a lighting circuit. The device 110 is attached to the load side of a circuit breaker 108 within a panel 100 using a conductor tab, i.e, the terminal 110A, inserted into the breaker lug 108B, see FIG. 2. The load terminal 110B comprises a lug of the same size as the breaker lug 108B for connecting to a wire to be connected to the load device. The device housing 110H is configured to mount in a Siemens type P1 panelboard, although the invention is not limited to such a configuration.

Figure 2:
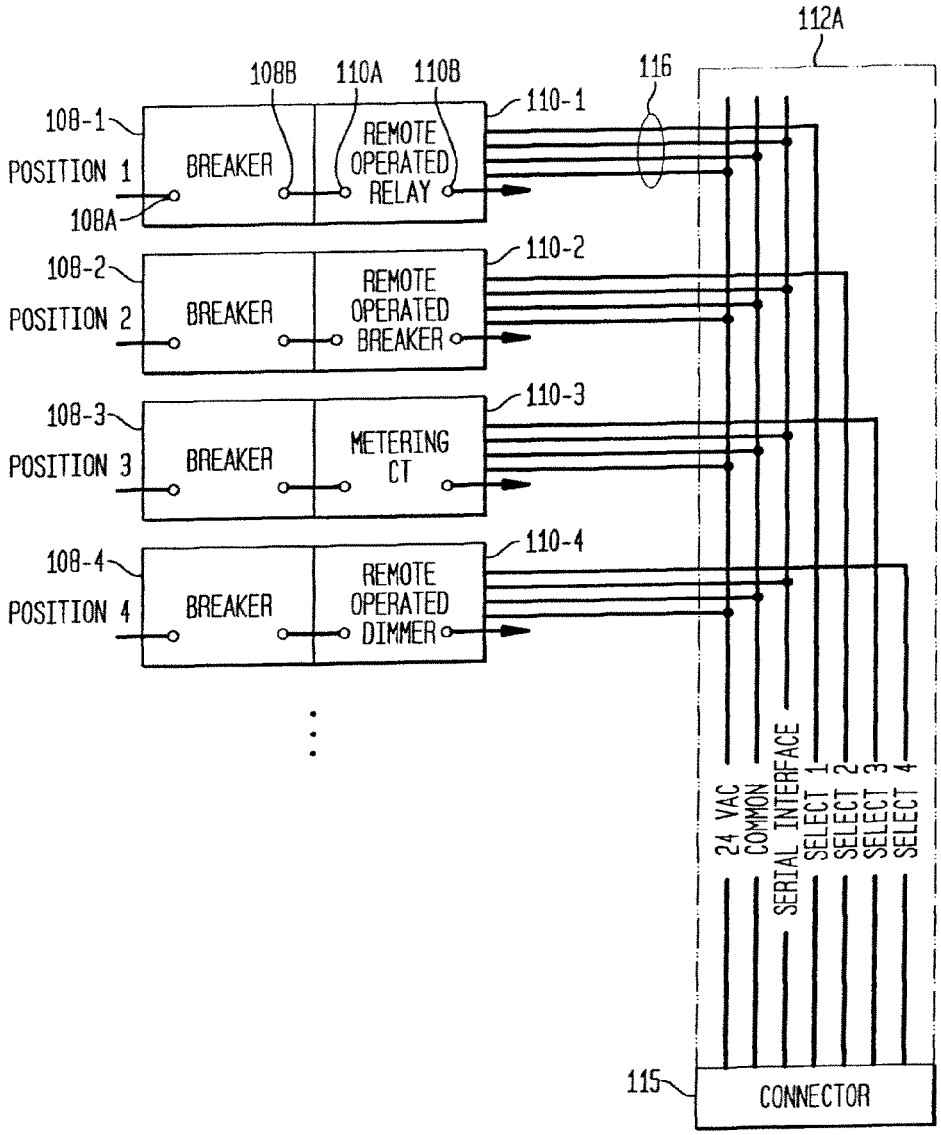
FIG. 2 is a block diagram illustrating pairs of circuit breakers and remote operated devices of the power distribution panel of FIG. 1.

Referring to FIG. 2, a block diagram illustrates four circuit breakers 108-1, 108-2, 108-3 and 108-4, and respective associated remote operated devices 110-1, 110-2, 110-3 and 110-4. In the illustrated embodiment, the first device 110-1 comprises a relay, the second device 110-2 comprises a breaker, the third device 110-3 comprises a current transformer, and the fourth device 110-4 comprises a dimmer. As is apparent, any combination of these remote operated devices 110 could be used. Each remote operated device 110 includes an input terminal 110A electrically connected to the associated circuit breaker load terminal 108B, and an output terminal 110B for connection to a load device.

The data rail 112 is mechanically attached directly to the interior of the lighting control panel 100. The data rail 112 comprises a shielded communication bus including a ribbon connector 115 having conductors to be routed to the panel controller 114. A wire harness 116 connects the data rail 112 to the remote operated device 110.

A detailed description of the data rail 112 and panel controller 114 are not provided herein. Instead, reference may be made to the detailed discussion of the same in the applications incorporated by reference herein. Indeed, the present invention does not require use of either a panel controller or data rail, as will be apparent.

The remote operated device 110, in the form of a relay, allows remote switching of an electrical branch load. The device 110 is designed to fit inside a standard electrical panel board with forty-two or more branch circuit breakers 108. The device 110 is an accessory to a branch circuit breaker 108 allowing repetitive switching of the load without effecting operation of the circuit breaker 108.

The remote operator device 110 requires a means to receive command signals to open or close and to report back successful operation or device status. Also required is a means to drive opening and closing of the switch mechanism contacts. With this design, electronic control circuitry is located inside the switching device itself. The use of a magnetically held solenoid or "mag latch" as a switching actuator results in very low energy requirements, requires short duration pulses to change position (measured in milliseconds), provides accurate and repeatable timing and requires that the control must reverse voltage polarity.

Figure 3:
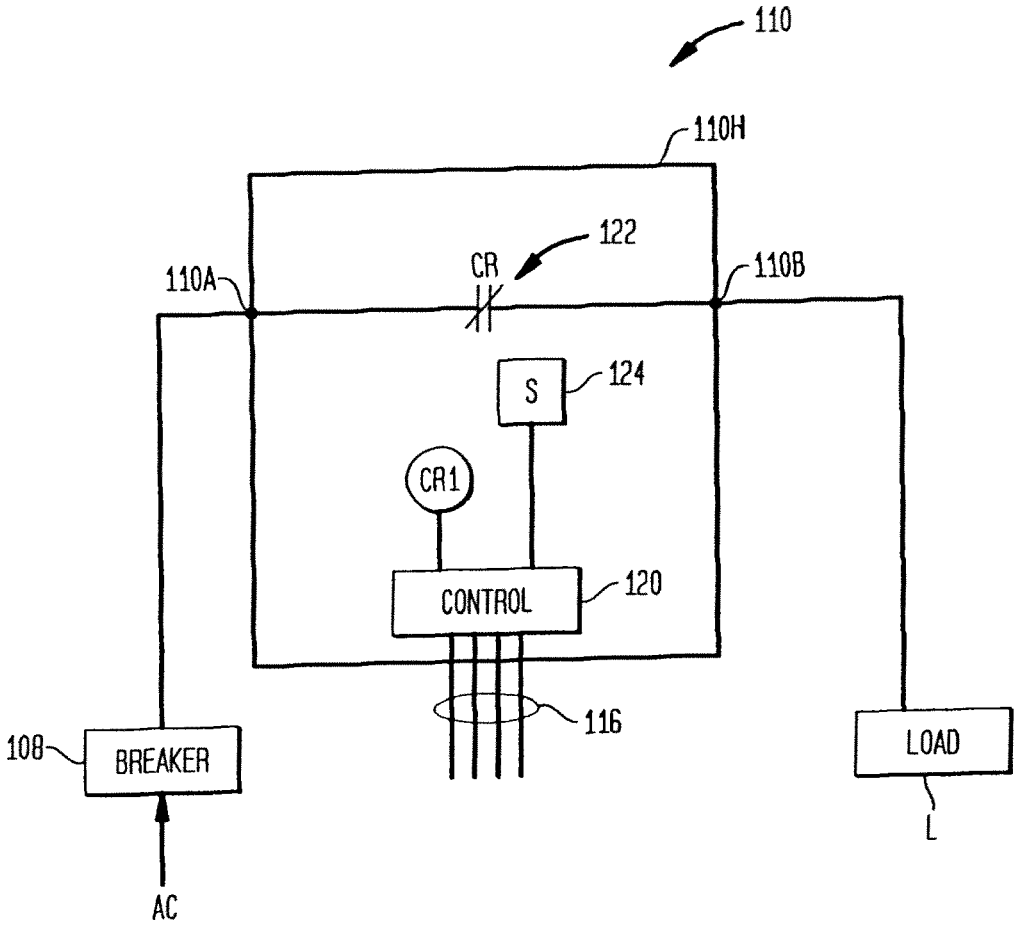
FIG. 3 is a basic block diagram of a remote operated control module in accordance with the invention.

FIG. 3 illustrates a basic block diagram for load switching. The remote operated device 110, in the form of a relay, includes a control circuit 120 connected to the wire harness 116. The control circuit 120 drives a control relay CR having a normally closed contact 122 connected between terminals 110A and 110B. A sensor 124, such as a switch, senses status of the relay CR and is connected to the control circuit 120. As such, the control circuit 120 controls operation of the contact 122 to selectively electrically connect a load L to the breaker 108, and thus to power the load L.

The control circuit 120 comprises a conventional microcontroller and associated memory, the memory storing software to run in the control circuit 120 in accordance with commands received from the panel controller 114.

Figure 4:
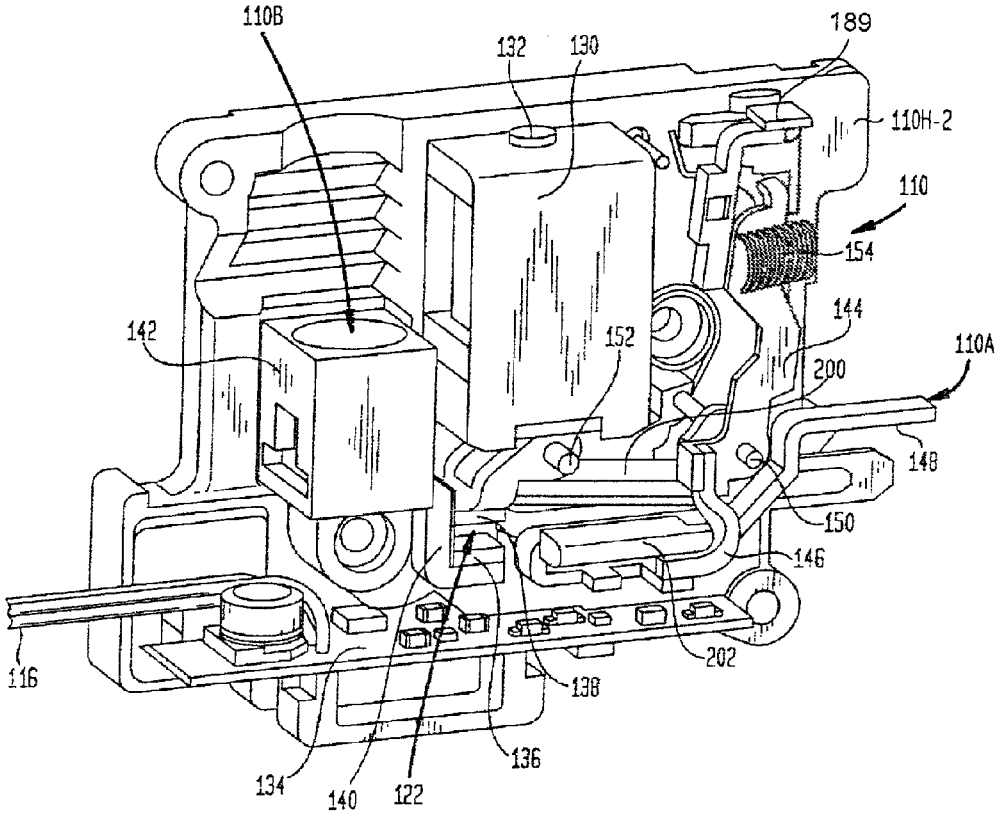
FIG. 4 is a perspective view of the control module with one part of the housing removed for clarity.
Figure 5:
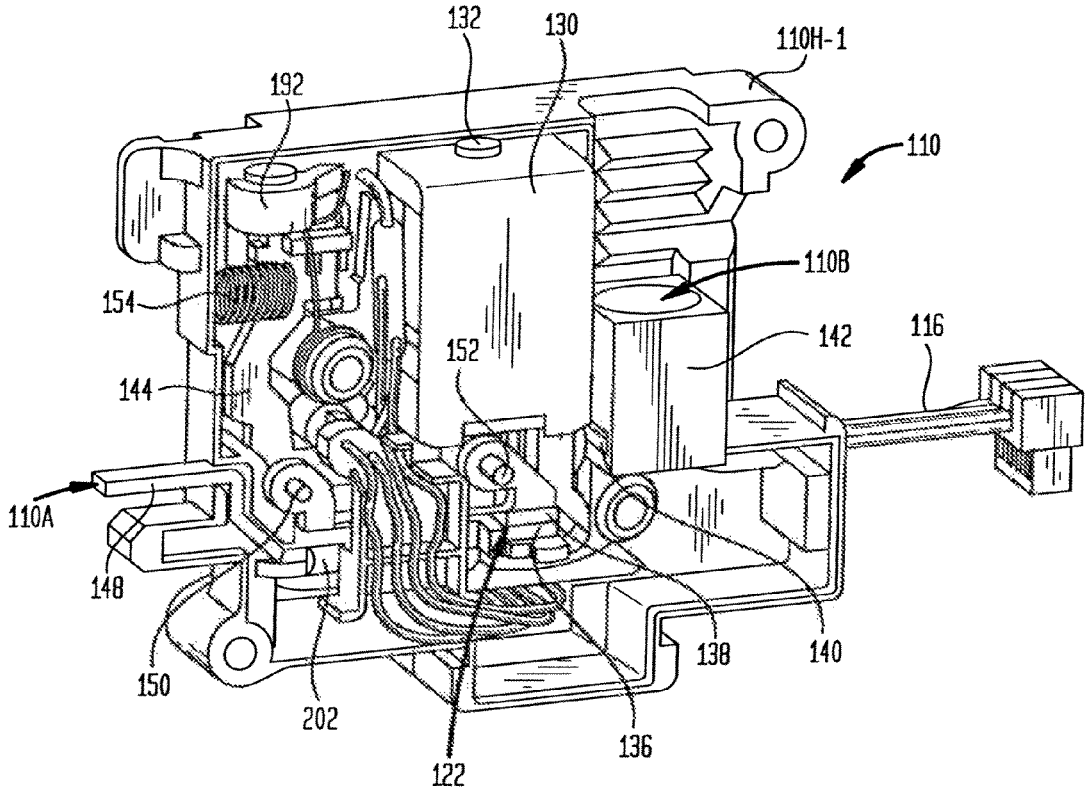
FIG. 5 is a perspective view of the control module with another part of the housing removed for clarity.

Referring to FIGS. 4 and 5, the control module 110 is illustrated in greater detail. The control module housing 110H, see FIG. 3, comprises a two piece housing comprising a base or first housing piece 110H-1, see FIG. 5, and a cover or second housing piece 110H-2, see FIG. 4. FIG. 4 illustrates the control module 110 without the first housing piece 110H-1, while FIG. 5 illustrates the control module 110 without the second housing piece 110H-2. The two housing pieces 110H-1 and 110H-2 are held together by fasteners, not shown, to form the housing 110H.

The control relay CR1, see FIG. 3, comprises a magnetically held solenoid including an actuator coil 130 operating an actuator plunger 132. The wire harness 116 is connected to a circuit board 134 including the control circuit 120, see FIG. 3, including an actuator drive circuit operatively connected to the coil 130. An open signal causes the drive circuit to apply negative voltage to the actuator coil 130 for a short period of time (about 10 to 30 milliseconds). This causes the actuator plunger 132 to pull in and become magnetically latched or held to open the contact 122, described more specifically below, in a conventional manner. A closed signal from the drive circuit applies a positive voltage to the actuator coil 130 for a shorter period of time (about 2 to 3 milliseconds). This period of time is sufficient for the actuator plunger 132 to become unlatched or release. Power is then removed from the coil 130. Since the actuator plunger 132 is stable in both the open and closed positions, energy is only required to change position.

The electrical switch 122 comprises a fixed contact 136 and a movable contact 138. The fixed contact 136 is mounted to a load terminal 140 connected to a lug 142 to define the terminal 110B. The movable contact 138 is mounted to a contact arm 144. A braid 146 is coupled between the contact arm 144 and a line terminal 148 to provide the conductor tab terminal 110A for connection to the circuit breaker, as discussed above.

The contact arm 144 is pivotally mounted in the housing 110H with a pivot pin 150. A wrist pin 152 connects the contact arm 144 to a lower end (not shown) of the plunger 132, as is apparent. An operating spring 154 biases the contact arm 144 so that normally the movable contact 138 is in electrical contact with the fixed contact 136, as shown in FIG. 5. When the solenoid 130 is latched, the plunger 132 raises the contact arm 144 via the wrist pin 152 to space the movable contact 138 from the fixed contact 136, as shown in FIG. 4.

Figure 6:
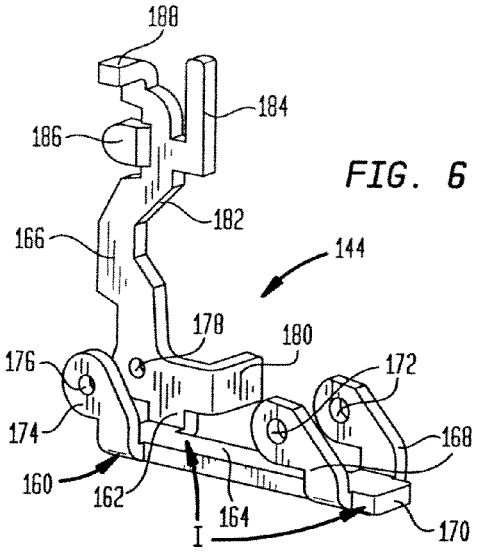
FIG. 6 is a perspective view of a contact arm of the control module in accordance with the invention.
Figure 7:
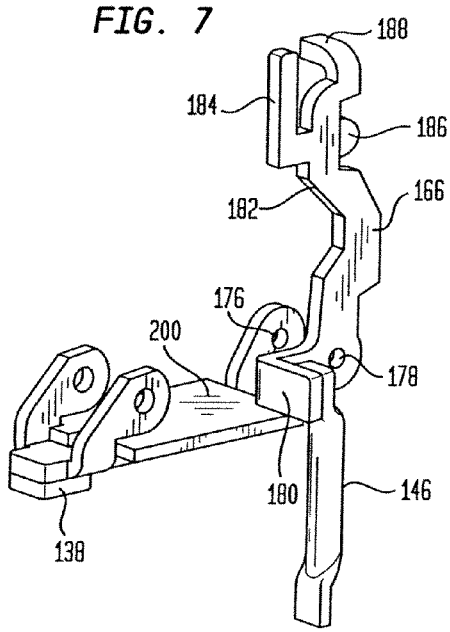
FIG. 7 is a perspective view illustrating various components secured to the contact arm.
Figure 8:
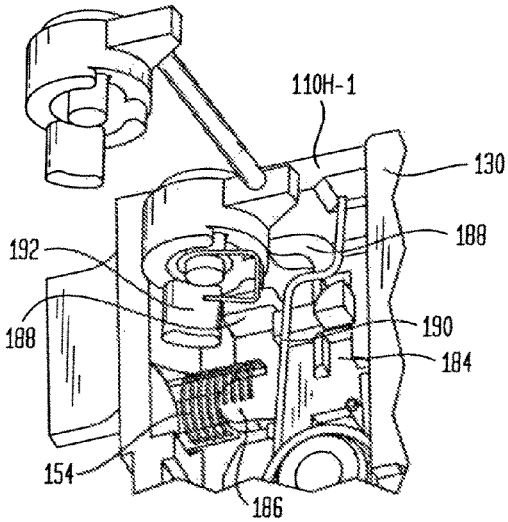
FIG. 8 is a cutaway, perspective view illustrating user interface devices in the control module in accordance with the invention.
Figure 9:
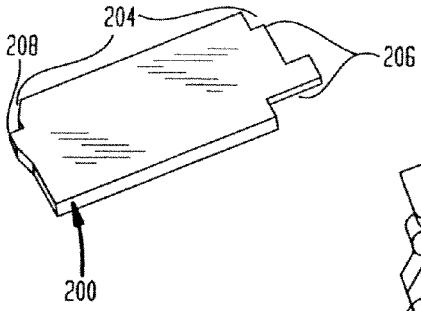
FIG. 9 is a perspective view of an armature plate for the control module in accordance with the invention.

Referring to FIG. 6, the contact arm 144 is illustrated. The contact arm is formed of a conductive material such as, for example, brass or copper, or the like. The contact arm 144 comprises an elongate bar 160 having a turn 162 defining a first leg 164 and a second leg 166. The first leg 164 defines a current path I. A pair of opposite protrusions 168 extend upwardly from a distal end 170 of the first leg 164 and include wrist pin holes 172 for receiving the wrist pin 152. A third protrusion 174 is provided at the first leg 164 proximate the turn 162 and includes a pivot hole 176 for receiving the pivot rod 150. Another pivot hole 178 is provided in the second leg 166. The second leg 166 includes a first tab 180, defining a connector tab, proximate the turn 162 for providing an electrical connection with the braid 146, as shown in FIG. 7. The movable contact 138 is affixed on the underside of the first leg distal end 170, as shown in FIG. 7. The braid 146 may be secured, as by welding or the like, to the connector tab 180. The second leg 166 includes a distal end 182 including an indicator mount tab 184, a spring mount tab 186 and an override interface mount tab 188. Referring also to FIG. 8, the operating spring 154 is captured on the spring mount tab 186 against the housing first piece 110H-1 to bias the contact arm 144, as discussed above. The indicator mount tab 184 operates a status indicator 189 normally biased by a spring 190. As such, the indicator mount tab 184 functions as a user interface operator. The status indicator 189 is visible externally to the housing, as generally illustrated in FIG. 4, to provide a "flag" indicating whether the contact 122 is in an open or closed position, based on position of the contact arm 144.

An override knob 192 is rotationally mounted in the housing 110H and is biased by a spring 194. The override knob 192 actuates the override interface mount tab 188. The knob 192 can be rotated to move the contact arm 144 manually to the actuated position to override the coil 130.

As described, the contact arm 144 performs numerous functions with a single part. The length and cross-section of the contact arm 144 provides an appropriate path for a current range of 15 to 50 amperes. The contact arm pivots about the pivot pin 150 to open or close the contact 122 responsive to pivotal movement of the contact arm 144 by the solenoid coil 130 or the override knob 192. The second leg 166 acts as an extension from the first leg 164 to make an "L" shaped part. This shape allows the operating spring 154 to be located far away from the contact which increases spring life by keeping the spring away from the heat generating contact. The second leg distal end 182 operates as a user interface with the tabs 184 and 188. Particularly, the indicator mount tab 184 provides the motion needed for indication via the status flag indicator 189 that is generated from the motion produced by the solenoid coil 130. The second leg distal end 182 also provides an interface via the override interface mount tab 188 with the override actuator knob 192. When the knob 192 rotates, it hits the end of the leg, thus overcoming the opposing magnetic forces of the magnetically latching solenoid, thus closing the contact 122. The contact arm first leg 164, provides a means for mounting an armature plate 200, see FIG. 7, as part of a blow closed contact system, described below. Finally, the contact arm 144, via the connector tab 180 provides for welding the braid 146, see FIG. 7. All of these functions are provided in a part that is only about 1.5" long.

As generally illustrated in FIGS. 4 and 5, the line terminal 148 wraps around a magnet 202. This creates a reverse loop of current which causes the magnet to attract to the armature plate 200. In an overcurrent event, the contacts 138 and 136 tend to repel one another. The combination of the magnet 202 and the armature plate 200 is designed to overcome the contacts tendency to open. With this design, the higher the current, the stronger the attraction between the magnet 202 and armature plate 200 to hold the contacts 136 and 138 together.

Figure 10:
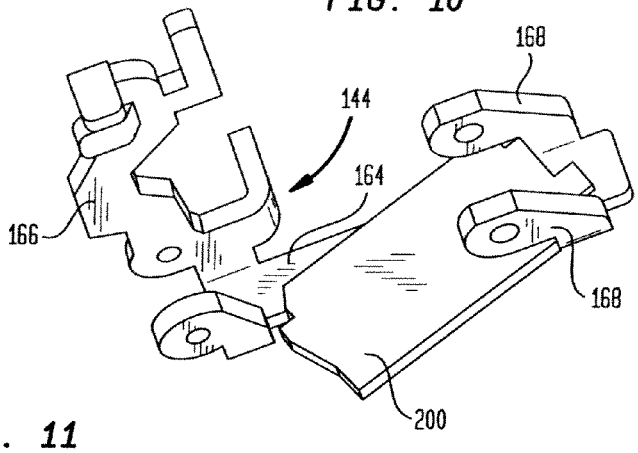
FIG. 10 is a perspective view illustrating the mounting of the armature plate to the contact arm.
Figure 11:
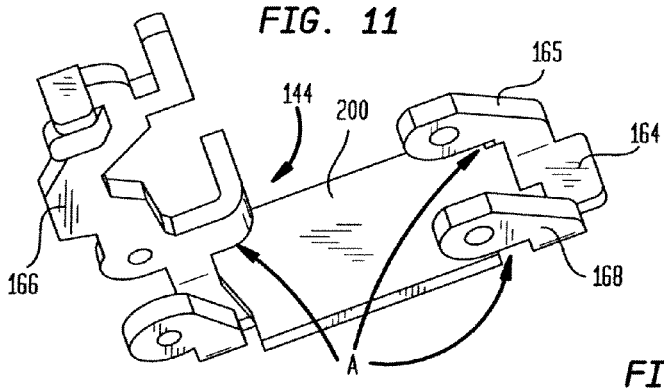
FIG. 11 is a perspective view illustrating the armature plate mounted to the contact arm.
Figure 12:
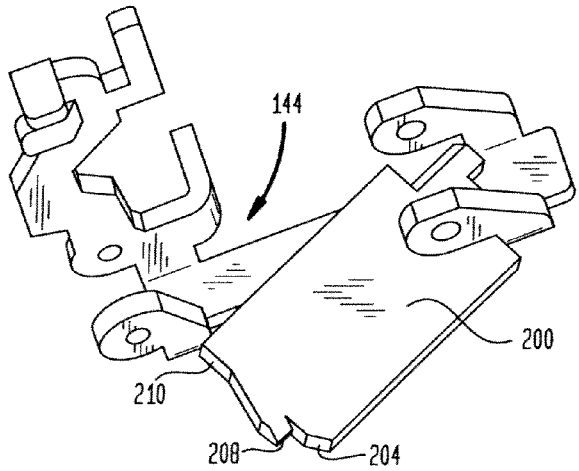
FIG. 12 is a perspective view illustrating a keying feature preventing incorrect mounting of the armature plate on the contact arm.

Referring to FIGS. 9-12, the armature plate 200 is keyed to the contact arm 144 to be mounted in a pre-select orientation and to be self aligning on the first leg 164. The contact arm 200 is generally rectangular shaped and includes two opposite corner edges 204 which align the contact arm 200 between one of the first leg projections 168 and the second leg 166. Another pair of edges 206 align the armature plate 200 between the first leg protrusions 168. Finally, a raised edge 208 aligns the armature plate 200 at the turn 162 after it is rotated into position. Particularly, FIG. 10 illustrates the armature plate 200 being slid into position, with the proper alignment as evident at points A. The armature plate 200 may be secured to the contact arm 144, for example, by welding or other securing means. FIG. 12 illustrates that overlap provided at an edge 210 opposite the edge 208 prevents the armature plate 200 from being installed upside down.

It is critical that the armature plate 200 lines up uniformly with the contact arm 144 and in accordance with the invention cannot be installed in an incorrect orientation. As such, the armature plate 202 self aligns, because the part is "keyed" to the contact arm 144. The alignment feature is based on the geometry and provides consistent assembly and welding of the parts during manufacturing. These features also eliminate the need for additional fixtures during the welding process and helps to temporarily hold the armature plate 200 in position before welding is complete.

Thus, in accordance with the invention, there is provided a contact arm for a movable contact in a control module which provides numerous functions, including carrying operating current and comprising a user interface.

The general configuration of the control modules 110 is presented by way of example. The contact arm and armature plate in accordance with the invention could be used with other configurations of relays or control modules adapted to form a switching device. While the disclosed configuration is advantageously used in a distribution panel, the contact arm and armature plate could similarly be used with stand-alone devices or the like.

I claim:

1. A switching device for selectively switching electrical power from an electrical power source to a load circuit comprising:

a housing;

an actuator mounted for controlled movement in the housing;

a fixed contact fixedly mounted in the housing and electrically connected to a first electrical terminal; and a conductive contact arm mounted in the housing, the contact arm being operatively connected to the actuator to be selectively positioned thereby and electrically connected to a second electrical terminal, the contact arm comprising an elongate bar having a turn defining opposite first and second legs, the first leg carrying a moveable contact for selectively electrically contacting the fixed contact, the second leg carrying a user interface operator.

2. The switching device of claim 1 wherein the user interface operator comprises a tab extending from a distal end of the second leg and further comprising a status indicator movably mounted in the housing and driven by the tab to indicate status of the switching device.

3. The switching device of claim 1 wherein the user interface operator comprises a tab extending from a distal end of the second leg and further comprising an override knob movably mounted in the housing and driving the tab to override the actuator.

4. The switching device of claim 1 wherein the second leg comprises a spring mount for receiving a spring for biasing the contact arm in a select position.

5. The switching device of claim 1 wherein the moveable contact is mounted to a distal end of the first leg and the second leg comprises an opening proximate the turn receiving a pivot rod for pivotally mounting the contact arm in the housing and a connector tab proximate the turn, and a conductor electrically connects the connector tab to the second terminal.

6. The switching device of claim 5 wherein the second leg comprises a spring mount at a distal end for receiving a spring for biasing the contact arm in a select position.

7. The switching device of claim 1 further comprising an armature plate mounted on the first leg.

8. The switching device of claim 7 wherein the armature plate is keyed to mount to the first leg in a preselect orientation.

9. The multipole switching device of claim 8 wherein the armature plate self aligns on the first leg.

10. A control module for selectively switching electrical power from an electrical power source to a load circuit comprising:

a housing;

an electromechanical actuator in the housing and having a moveable plunger;

a fixed contact fixedly mounted in the housing and electrically connected to a first electrical terminal; and a conductive contact arm in the housing comprising an elongate bar having a turn defining opposite first and second legs, the contact arm being pivotally mounted in the housing proximate the turn and operatively connected to the plunger to be selectively positioned thereby, the contact arm further comprising a conductor tab proximate the turn, the first leg including a moveable contact for selectively electrically contacting the fixed contact, and the second leg including a user interface operator.

11. The control module of claim 10 wherein the user interface operator comprises a tab extending from a distal end of the second leg and further comprising a status indicator movably mounted in the housing and driven by the tab to indicate status of the switching device.

12. The control module of claim 11 wherein the user interface operator comprises a tab extending from a distal end of the second leg and further comprising an override knob movably mounted in the housing and driving the tab to override the actuator.

13. The control module of claim 12 wherein the second leg comprises a spring mount for receiving a spring for biasing the contact arm in a select position.

14. The control module of claim 13 wherein the moveable contact is mounted to a distal end of the first leg and the second leg comprises an opening proximate the turn receiving a pivot rod for pivotally mounting the contact arm in the housing and a connector tab proximate the turn, and a conductor electrically connects the connector tab to the second terminal.

15. The two pole switching device of claim 14 wherein the second leg comprises a spring mount at a distal end for receiving a spring for biasing the contact arm in a select position.

16. The control module of claim 10 further comprising an armature plate mounted on the first leg.

17. The control module of claim 16 wherein the armature plate is keyed to mount to the first leg in a preselect orientation.

18. The control module of claim 17 wherein the armature plate self aligns on the first leg.

* * * * *